US006440268B1

(12) United States Patent
Baggot et al.

(10) Patent No.: US 6,440,268 B1
(45) Date of Patent: Aug. 27, 2002

(54) HIGH BULK TISSUE WEB

(75) Inventors: James Leo Baggot, Menasha; Michael Earl Daniels; David Robert Gruber, both of Neenah; Paul Kerner Pauling, Appleton; James D. Ba Dour, Jr., Green Bay; Larry E. Birnbaum, Green Bay; Rudolph S. Fortuna, Green Bay, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/514,734

(22) Filed: Feb. 28, 2000

Related U.S. Application Data

(63) Continuation-in-part of application No. 08/845,098, filed on Apr. 16, 1997, now Pat. No. 6,030,496.

(51) Int. Cl.[7] ..... D21F 5/00

(52) U.S. Cl. ..... 162/118; 162/109; 162/120; 162/283; 242/540; 242/548; 242/551; 242/554; 242/555.1; 242/555.7; 242/559; 242/564

(58) Field of Search ..... 162/109, 111, 162/118, 120, 283, 193; 242/551, 556, 545, 545.1, 555.1, 555.7, 548, 559, 540, 564

(56) References Cited

U.S. PATENT DOCUMENTS

| | | | | |
|---|---|---|---|---|
| 2,617,606 A | 11/1952 | Whatmore | 242/58 |
| 4,466,577 A | 8/1984 | Focke et al. | 242/58 |
| 4,735,372 A | 4/1988 | Seki | 242/58.1 |
| 4,944,470 A | 7/1990 | Mobley | 242/58.4 |
| 4,969,588 A | 11/1990 | Baker | 226/91 |
| 5,289,984 A | 3/1994 | Sohma | 242/58.3 |
| 5,360,502 A | 11/1994 | Andersone | 156/285 |
| 5,709,354 A | 1/1998 | Blandin et al. | 242/551 |
| 5,772,845 A | 6/1998 | Farrington et al. | 162/109 |

*Primary Examiner*—Peter Chin
(74) *Attorney, Agent, or Firm*—Thomas J. Connelly; Patricia Charlier; Douglas G. Glantz

(57) ABSTRACT

A partially unwound roll is moved for splicing with a subsequent parent roll, and the united web is rewound. The torque transmitting means include side clamping mechanisms engaging only the end surfaces of the parent rolls. In one aspect, an automated off-line apparatus and method splice tissue webs from different parent rolls in a finishing unit, and substantially continuous impacts on each web during unwinding splice the webs together. In one aspect, an apparatus and method are disclosed for the production of a soft, high bulk uncreped throughdried tissue web by depositing an aqueous suspension of papermaking fibers onto an endless forming fabric to form a web and through drying the web to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density. A torque transfer device for unwinding a tissue roll includes a frame having a pair of arms spaced apart to accommodate the width of the roll, each arm having a side clamping mechanism mounted thereon to engage one of the opposite end surfaces of the tissue roll. The side clamping mechanism includes a backing plate connected to and rotatable with an unwind shaft connected to an electric drive, an inflatable bladder mounted on the backing plate, and means for inflating the bladder such that the opposite end surfaces of the roll are sandwiched between the side clamping mechanisms.

20 Claims, 12 Drawing Sheets

HIGH BULK TISSUE WEB

This application is a continuation-in-part of application Ser. No. 08/845,098 filed on Apr. 16, 1997, now U.S. Pat. No. 6,030,496.

BACKGROUND OF INVENTION

1. Technical Field

This invention relates to a high bulk tissue web and method of making and processing a high bulk tissue web. In one aspect, this invention relates to a method of making a high bulk tissue web wound on large diameter parent rolls, unwound for finishing operations, and subsequently rewound.

2. Background

A large diameter manufactured parent roll of bathroom tissue or kitchen toweling can be unwound for finishing operations, such as for calendering, embossing, printing, ply attachment, perforating, or for a combination of two or more finishing operations. The finished bathroom tissue or kitchen toweling then can be rewound into a retail-sized log or roll.

At the time a parent roll runs out, the spent shaft or core can be removed from the machine, and a new roll moved into position by an overhead crane or extended level rails.

Core plugs can support the parent roll on an unwind stand with unwinding power coming from a belt or belts operating on a parent roll surface.

INTRODUCTION TO THE INVENTION

A surface-driven unwind system is not suitable for all types of tissue webs because of a decrease in a machine direction stretch, a reduction of bulk, or damage to the surface of the tissue web, particularly in high bulk tissue webs.

Center driven unwind systems can unwind film.

A down time associated with a parent roll change represents a substantial reduction in total available run time.

The manpower required to change a parent roll reduces the efficiency of a rewinder line and reduces the productivity of neighboring operations when workers are borrowed for roll changes.

Where a finishing unit bonds the expiring web and the new web together, the webs can be threaded manually and advanced. The manual operation reduces efficiencies significantly.

Consequently, a parent roll change reduces the maximum output obtained from a rewinder line and reduces the productivity of neighboring operations as well.

Accordingly, a method for making and processing a web is needed for maintaining preferred characteristics of the web, such as the bulk and the uniformity of the web. A method for making and processing a web also is needed for reducing the time the machine is stopped, to increase overall efficiency, and to provide safety for all personnel.

SUMMARY OF THE INVENTION

The apparatus and method of the present invention for making and processing a high bulk tissue web include depositing an aqueous suspension of papermaking fibers onto an endless forming fabric to form a web, drying the web to form a dried web having a bulk of 9.0 grams per cubic centimeter or greater, winding the dried web to form a plurality of parent rolls each comprising a web wound on a core, and transporting the parent rolls to an unwind stand having novel torque transmitting clamping means for engaging opposite end surfaces of the parent rolls. The novel clamping means engage a first parent roll, partially unwind the first parent roll using variable speed drive operably associated with the clamping means, and rotatably support the partially unwound first parent roll on a core placement table adapted to receive the partially unwound first parent roll from the clamping means. Torque transmitting clamping means engage on a second parent roll. A leading end portion of the web on the second parent roll is joined to a trailing end portion of the partially unwound first parent roll by embossing to form a joined web without glue, and the joined web is rewound. The leading end portion of the web on the second parent roll is transported with a thread-up conveyor with vacuum means operably associated with an endless screen belt means.

In one aspect, a novel apparatus and method of making and processing high bulk tissue webs produce a soft, high bulk uncreped throughdried tissue web by depositing an aqueous suspension of papermaking fibers onto an endless forming fabric to form a web and drying the web by throughdrying to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density.

In one aspect, the apparatus and method of the present invention join a leading end portion of the web on the second parent roll to a trailing end portion of the partially unwound first parent roll to form a joined web without glue in a finishing unit having rolls defining a finishing unit nip, thereafter substantially continuously forming impacts on the web from the first parent roll in the finishing unit nip while the web is unwound from the first parent roll, transporting the web from the second parent roll to the finishing unit, simultaneously passing the webs from both the first and second parent rolls through the finishing unit nip to join the webs together, substantially continuously forming impacts on the web from the second parent roll in the finishing unit nip while the web is unwound from the second parent roll, and rewinding the joined web. The finishing units include an embossing unit, a calendering unit, or a crimping unit.

A torque transfer device for unwinding a tissue roll having a circumferential surface, opposite end surfaces, an inner core surface, an outside diameter of at least about 60 inches, and a width between the opposite end surfaces of at least about 55 inches includes a frame having a pair of arms spaced apart to accommodate the width of the roll, each arm having a side clamping mechanism mounted and adapted to engage one of the opposite end surfaces of the tissue roll, the side clamping mechanism including a backing plate operably connected to and rotatable with an unwind shaft connected to an electric drive, an inflatable bladder mounted on the backing plate, and means for inflating the bladder such that the opposite end surfaces of the roll are sandwiched between the side clamping mechanisms.

DETAILED DESCRIPTION

Figure 1:
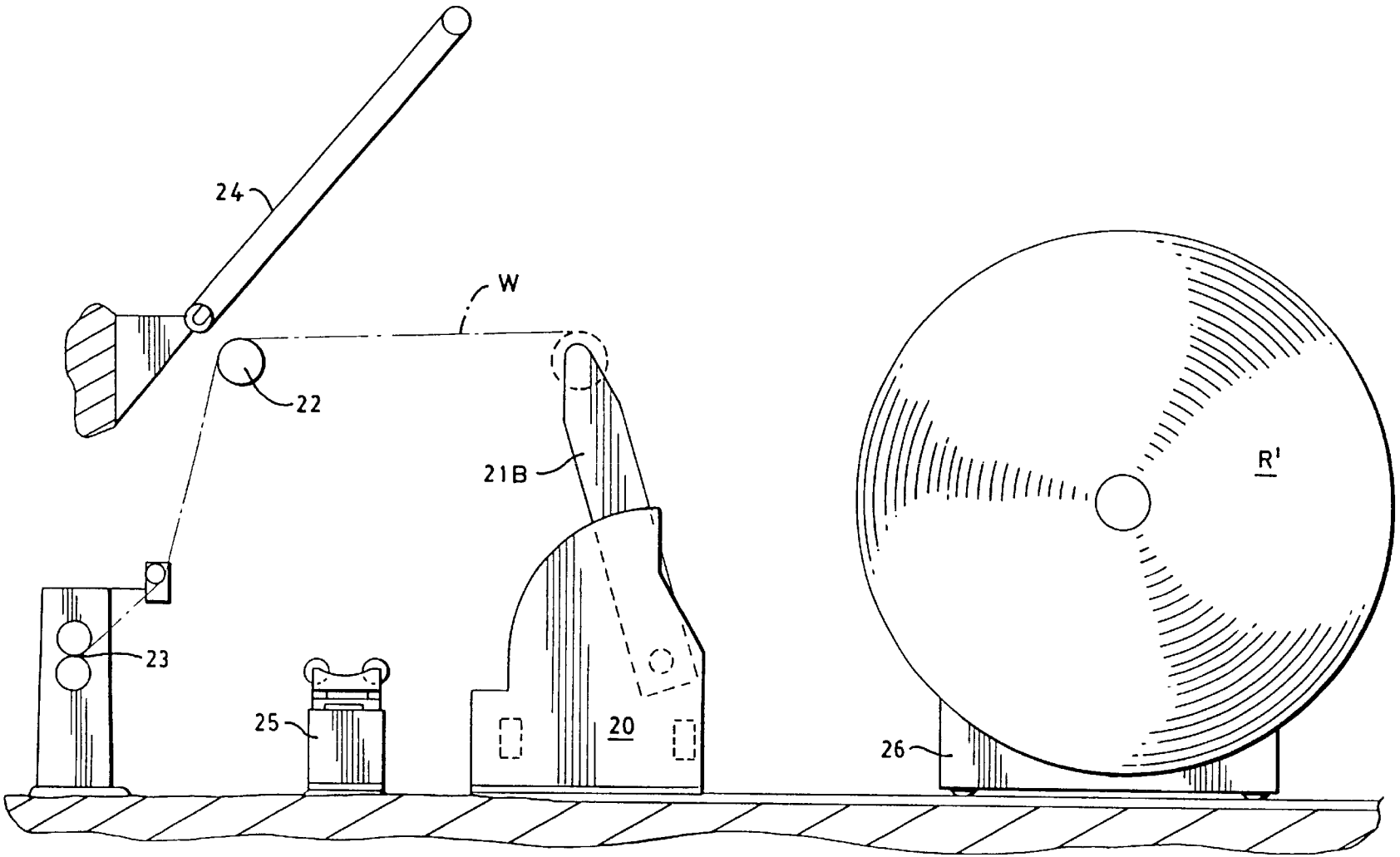
FIG. 1 is a schematic side elevational view of an unwind operation near the end of an unwind cycle.

The apparatus and method of the present invention provide a novel converting unwinding process. The apparatus and method of the present invention provide a tissue web wound on large diameter parent rolls, unwound using a center drive unwind system, and subsequently rewound into retail sized products.

Previous tissue unwinds have made use of core plugs for support on unwind stands with the power for unwinding coming from belts on the parent roll surface. In contrast, the apparatus and method of the present invention provide center driving not previously available in tissue stock unwinding.

It has been found that the apparatus and method of the present invention reduce the down time associated with parent roll change at a substantial increase in total available run time, reduce manpower required to change a parent roll, and further increase the maximum output obtained from a rewinder line.

The apparatus and method of the present invention provide a novel and improved web and method for making a web having web characteristics of bulk and uniformity of web, produce a web in a dramatically reduced time during when the machine is actually stopped, significantly improve overall efficiency, and maintain or improve safety for all personnel.

The apparatus and method of the present invention provide a soft, high bulk uncreped throughdried tissue web by depositing an aqueous suspension of papermaking fibers onto an endless forming fabric to form a web, drying the web, winding the dried web to form parent rolls having a web wound on a core, transporting the parent rolls to a frame including a pair of horizontally spaced apart side arms and novel torque transmitting clamping means; engaging the novel clamping means onto a first parent roll core; moving the arms to transport the first parent roll core to an unwind position, partially unwinding the first parent roll using a variable speed drive operably associated with the novel clamping means, moving the arms and the partially unwound first parent roll toward a core placement table, the core placement table adapted to receive from the arms the partially unwound first parent roll, rotatably supporting the partially unwound first parent roll on the core placement table, moving the arms away from the core placement table, engaging the novel clamping means onto a second parent roll, joining a leading end portion of the web on the second parent roll to a trailing end portion of the partially unwound first parent roll to form a joined web, and rewinding the joined web.

In one aspect, the apparatus and method of the present invention provide a united web and method for uniting the webs of the parent rolls using a thread-up conveyor. In one aspect, the leading end portion of the web on the second parent roll is transported by the threadup conveyor by a vacuum operably associated with an endless screen belt. The leading end portion of the web on the second parent roll is transported over the endless screen belt with decreasing amounts of vacuum. The leading end portion of the web on the second parent roll is disposed on the trailing end portion of the web on the partially unwound first parent roll, and the thread-up conveyor and unwinding the second parent roll are operated at a same surface speed.

It has been found that the thread-up conveyor may be moved, and in particular pivoted, relative to the second parent roll between an active position and a standby position. In the active position, the thread-up conveyor is in close proximity to or in contact with the second parent roll. In the standby position, the thread-up conveyor is away from the parent roll for ease of operator access.

The apparatus and method of the present invention provide a core placement table moveable in a direction transverse to the path of travel of the web between an inline position and a standby position. The inline position corresponds to the web centerline to enable partially unwound parent rolls to be placed on the core placement table, whereas in the standby position the core placement table is away from the unwinding operation for ease of operator access.

The apparatus and method of the present invention produce soft, high bulk uncreped throughdried tissue sheets having bulk values of 9 cubic centimeters per gram or greater and a relatively low stiffness as determined by the MD Max Slope and/or the MD Stiffness Factor. The apparatus and method of the present invention produce soft, high bulk uncreped throughdried tissue sheets having a machine direction stretch of about 10 percent or greater and a substantially uniform density.

The apparatus and method of the present invention handle parent roll cores having an outside diameter of at least about 14 inches and parent rolls having an outside diameter of at least about 60 inches and a width of at least about 55 inches.

It has been found that the apparatus and method of the present invention eliminate or reduce the detrimental effects on the web, including (1) surface damage including scuffing and tearing, (2) web wrinkling, (3) de-bulking, and (4) stretch loss.

It has been found that the apparatus and method of the present invention preserve the tissue web attributes of high bulk and stretch during the unwinding process.

In one aspect, the present invention provides a method of making and processing a high bulk tissue web, including the steps of depositing an aqueous suspension of papermaking fibers onto an endless forming fabric to form a web, drying the web to form a dried web having a bulk of 9.0 grams per cubic centimeter or greater, winding the dried web to form a plurality of parent rolls each including a web wound on a core, transporting the parent rolls to an unwind stand including a pair of spaced apart arms, each arm including torque transmitting means for engaging a parent roll, engaging the torque transmitting means with a first parent roll, partially unwinding the first parent roll using variable speed drive means operably associated with the torque transmitting means, rotatably supporting the partially unwound first parent roll on a core placement table adapted to receive the partially unwound first parent roll from the arms, engaging the torque transmitting means with a second parent roll, joining a leading end portion of the web on the second parent roll to a trailing end portion of the partially unwound first parent roll to form a joined web, and rewinding the joined web.

In one aspect, a method of making and processing a high bulk, uncreped throughdried tissue web includes the steps of depositing an aqueous suspension of papermaking fibers onto an endless forming fabric to form a web, transferring the web to a throughdrying fabric, throughdrying the web to form an uncreped throughdried web having a bulk of 6.0 grams per cubic centimeter or greater, winding the dried web to form a plurality of parent rolls each including an uncreped throughdried web wound on a core, transporting the parent rolls to an unwind stand including a pair of spaced apart arms, each arm including torque transmitting means for engaging a parent roll, engaging the torque transmitting means with a first parent roll, partially unwinding the first parent roll using variable speed drive means operably associated with the torque transmitting means, rotatably supporting the partially unwound first parent roll on a core placement table adapted to receive the partially unwound first parent roll from the arms, engaging the torque transmitting means with a second parent roll, joining a leading end portion of the web on the second parent roll to a trailing end portion of the partially unwound first parent roll to form a joined web, and rewinding the joined web.

The unwind stand includes a frame having pivotally mounted arms. The arms preferably move the first parent roll to an unwind position for partially unwinding the first parent roll, then move the first parent roll to a position in close proximity to or contact with the core placement table, and then move the second parent roll to an unwind position for partially unwinding the second parent roll core. When the webs from the first and second parent rolls are being spliced together, the variable speed drive means and a core placement drive motor simultaneously unwind the first and second parent rolls.

The webs of the parent rolls preferably are united using a thread-up conveyor. The leading end portion of the web on the second parent roll is transported by the thread-up conveyor, which preferably includes a vacuum means operably associated with an endless screen belt means. In one aspect, the leading end portion of the web on the second parent roll is transported over the endless screen belt means with decreasing amounts of vacuum. When the leading end portion of the web on the second parent roll is positioned on the trailing end portion of the web on the partially unwound first parent roll, the thread-up conveyor and unwinding of the second parent roll are operated at a same surface speed.

The thread-up conveyor is moved and pivoted relative to the second parent roll between an active position and a standby position. In the active position, the thread-up conveyor is in close proximity to or in contact with the second parent roll. In the standby position, the thread-up conveyor is positioned away from the parent roll.

The core placement table preferably is moveable in a direction transverse to the path of travel of the web between an inline position and a standby position. The in-line position corresponds to the web centerline to enable partially unwound parent rolls to be placed on the core placement table. In the standby position, the core placement table is positioned away from the unwinding operation for ease of operator access.

Suitable soft, high bulk tissues for purposes of the present invention include tissue sheets as described in U.S. Pat. No. 5,607,551 issued Mar. 4, 1997 to Farrington, Jr. et al. entitled "Soft Tissue," which is herein incorporated by reference and made a part of this specification description.

The novel method of the present invention is particularly preferred for soft, high bulk uncreped throughdried tissue sheets. Such tissues have bulk values of 6.0 cubic centimeters per gram or greater before calendering, preferably about 9 cubic centimeters per gram or greater, more specifically from about 10 to about 35 cubic centimeters per gram, and still more specifically from about 15 to about 25 cubic centimeters per gram. The method for measuring bulk is described in the Farrington, Jr. et al. U.S. Pat. No. 5,607,551.

The soft, high bulk tissues of the present invention are characterized by a relatively low stiffness as determined by the MD Max Slope and/or the MD Stiffness Factor, the measurement of which also is described in the Farrington, Jr. et al. U.S. Pat. No. 5,607,551. More specifically, the MD Max Slope, expressed as kilograms per 3 inches of sample, is about 10 or less, preferably about 5 or less, and more specifically from about 3 to about 6. The MD Stiffness Factor for tissue sheets of the present invention, expressed as (kilograms per 3 inches)-microns$^{0.5}$, can be about 150 or less, more specifically about 100 or less, and still more specifically from about 50 to about 100. Furthermore, the soft, high bulk tissues of the present invention have a machine direction stretch of about 10 percent or greater, specifically from about 10 to about 30 percent, and more specifically from about 15 to about 25 percent. In addition, the soft, high bulk tissue sheets of the present invention have a substantially uniform density since they are preferably throughdried to final dryness without any significant differential compression.

Parent roll cores used in the present method have an outside diameter of at least about 14 inches and particularly about 20 inches. The parent rolls have a face or circumferential surface, an inner core surface, and opposite end surfaces. The outside diameters of the rolls are at least 60 inches and in particular 120 inches or greater, such as 140 inches or greater. The widths of the parent rolls measured between the opposite end surfaces are at least 55 inches and particularly at least 100 inches, such as 105 inches or greater. The weights of the rolls are over 2000 lbs., preferably 3000 lbs. or more, and more preferably 4000 lbs. or more.

In one aspect, a center driven unwind operation of the present invention has been found to eliminate or reduce detrimental effects on the web including 1. surface damage (scuffing, tearing, etc.), 2. wrinkling of the web, 3. de-bulking, and 4. stretch loss. All of these detrimental effects are found in a surface driven unwind on a low-density base sheet, such as an uncreped through-air-dried base sheet. These detrimental effects reduce the quality of the off-line finishing processes and the finished product. A large factor in creating these defects is the differential across the circumferential surface of a parent roll because of the limited contact area with the surface driven unwind belts. Specifically, the defects include 1. surface damage which introduces defects or tears affecting product performance and process runability, 2. wrinkling which reduces the quality of the processes such as calendering, embossing, printing, ply-bonding, perforating, and rewinding, thereby reducing the quality of the finished product appearance, performance, and process runability, 3. de-bulking which results in a denser web which affects product performance and preference, and 4. stretch loss which affects product performance and process runability.

The center driven unwind preserves web attributes such as high bulk and stretch during the unwinding process. The web also is treated consistently across the circumferential surface of the parent roll. Draw control further protects the web.

As an alternative to the center driven unwind, or in combination with the center driven unwind, a side clamping mechanism of one or more inflatable bladders engage the opposite end surfaces of the parent rolls.

A torque transmitting means engaging the opposite end surfaces of the parent rolls transfers torque to the roll for unwinding. A supplemental torque transfer is preferred for high bulk sheets because the wound-in tension in the roll is reduced to protect the web properties.

Lower wound-in tension decreases the ability to drive the roll from the core.

In high bulk sheets, a center-driven unwind operation alone creates the potential for slippage or shifting between the individual layers of the roll as well as between the initial sheet layers and the core, especially during periods of high acceleration or deceleration. Rapid speed changes combined with a large mass moment of inertia produces high torque requirements and very large circumferential forces, especially in areas near the core. The combination of large forces and lower interlayer pressures increases the likelihood of shifting between sheet layers, which leads to problems in the unwinding sequence such as web velocity or tension variability, telescoping of the parent roll, and severe wrinkling of the web.

In one aspect, the supplemental torque transfer means transmits torque from the unwind shaft through the roll via the one or more inflatable bladders in pressure contact with the opposite end surfaces of the parent roll. The bladders are supported by a backing plate operatively attached to the unwind shaft. The bladders are deflated and disengaged as the parent roll is unwound to smaller diameters to eliminate disturbances with the web as it is peeled away from the roll. The bladders are formed of an air or fluid impermeable material conformable to the end surfaces of the parent rolls, including, for example, rubber, polyurethane, or synthetic polymers. Bladder material has a coefficient of friction of 0.3 or greater, preferably about 0.5 or greater.

In one aspect of the present invention, the torque transfer device unwinds a tissue roll having a circumferential surface, opposite end surfaces, an inner core surface, an outside diameter of at least about 60 inches, and a width between the opposite end surfaces of at least about 55 inches. The torque transfer device includes a frame having a pair of arms spaced apart to accommodate the width of the roll between the two arms. Each arm includes a side clamping mechanism mounted on the arm and adapted to engage one of the opposite end surfaces of the tissue roll. The side clamping mechanisms include a backing plate operably connected to and rotatable with an unwind shaft connected to an electric drive. The side clamping mechanisms include an inflatable bladder mounted on the backing plate and means for inflating the bladder such that the opposite end surfaces of the roll are sandwiched between the side clamping mechanisms.

The advantages attributable to the supplemental torque transfer means compared to traditional unwind assist devices, such as surface belts and rider rolls, include low engagement pressures because of the large available contact area. The circumferential surface of the roll is not damaged. Torque is transmitted directly to a significant portion of the roll versus through the core and/or the circumferential surface of the roll. Operators can observe the complete circumferential surface of the roll.

The novel method for making a web of the present invention dramatically reduces down time needed to splice parent roll webs. The method utilizes a finishing operation of substantially continuous impacts on the web to splice the webs together. For purposes of the present invention, finishing operations of substantially continuous impacts on the web include embossing, crimping, and calendering. These finishing operations preferably make for an impact on the web over the full width of the web so that a full-width splice is produced between the webs for improved strength. The term "substantially continuous impact" is used herein to refer to structural modifications on the surface characteristics of the web, either continuously as in calendering or substantially continuously as in embossing or crimping, and to a joined web for rewinding purposes when two webs from different parent rolls are processed simultaneously. In contrast, separate bonding units are only intermittently operated to form a splice between webs from different rolls. Also in contrast, methods injecting bonding agents, such as glue, tape, or the like, bond the webs together.

In one aspect, the present invention provides a method of joining or splicing tissue webs without glue or tape, including the steps of partially unwinding a first tissue web from a first parent roll using drive motor means, transporting the first tissue web to a finishing unit including rolls defining a finishing unit nip, substantially continuously forming impacts solely on the first tissue web in the finishing unit nip while the first tissue web is unwound from the first parent roll using drive motor means, partially unwinding a second tissue web from a second parent roll, transporting the second tissue web to the finishing unit using drive motor means, maintaining the first and second tissue webs moveable relative to one another upstream of the finishing unit, simultaneously unwinding both the first and second tissue webs from the first and second parent rolls using drive motor means and passing the webs jointly through the finishing unit nip to bond the webs together, and substantially continuously forming impacts solely on the second tissue web in the finishing unit nip while the second tissue web is unwound from the second parent roll using drive motor means.

The webs from the expiring roll and the new roll both are driven through the first process nip and are not bonded together until the first process nip. Utilizing the first finishing operation after the unwind to join or splice different parent roll webs together eliminates the need for separate bonding units and eliminates the need for external bonding means such as glue or tape.

The present method replaces existing manual methods such as threading each new web or tying webs together.

The tissue product of the present invention can be one-ply, two-ply, three-ply, or more plies. The individual plies can be layered or non-layered (homogeneous) and uncreped and through-dried. For purposes herein, "tissue sheet" is a single ply sheet suitable for facial tissue, bath tissue, towels, or napkins having a density of from about 0.04 grams per cubic centimeter to about 0.3 grams per cubic centimeter and a basis weight of from about 4 to about 40 pounds per 2880 square feet. Tensile strengths in the machine direction are in the range of from about 100 to about 5,000 grams per inch of width. Tensile strengths in the cross-machine direction are in the range of from about 50 to about 2500 grams per inch of width. Cellulosic tissue sheets of paper-making fibers are preferred, although synthetic fibers can be present in significant amounts.

The invention is described in conjunction with the accompanying drawings.

Figure 2:
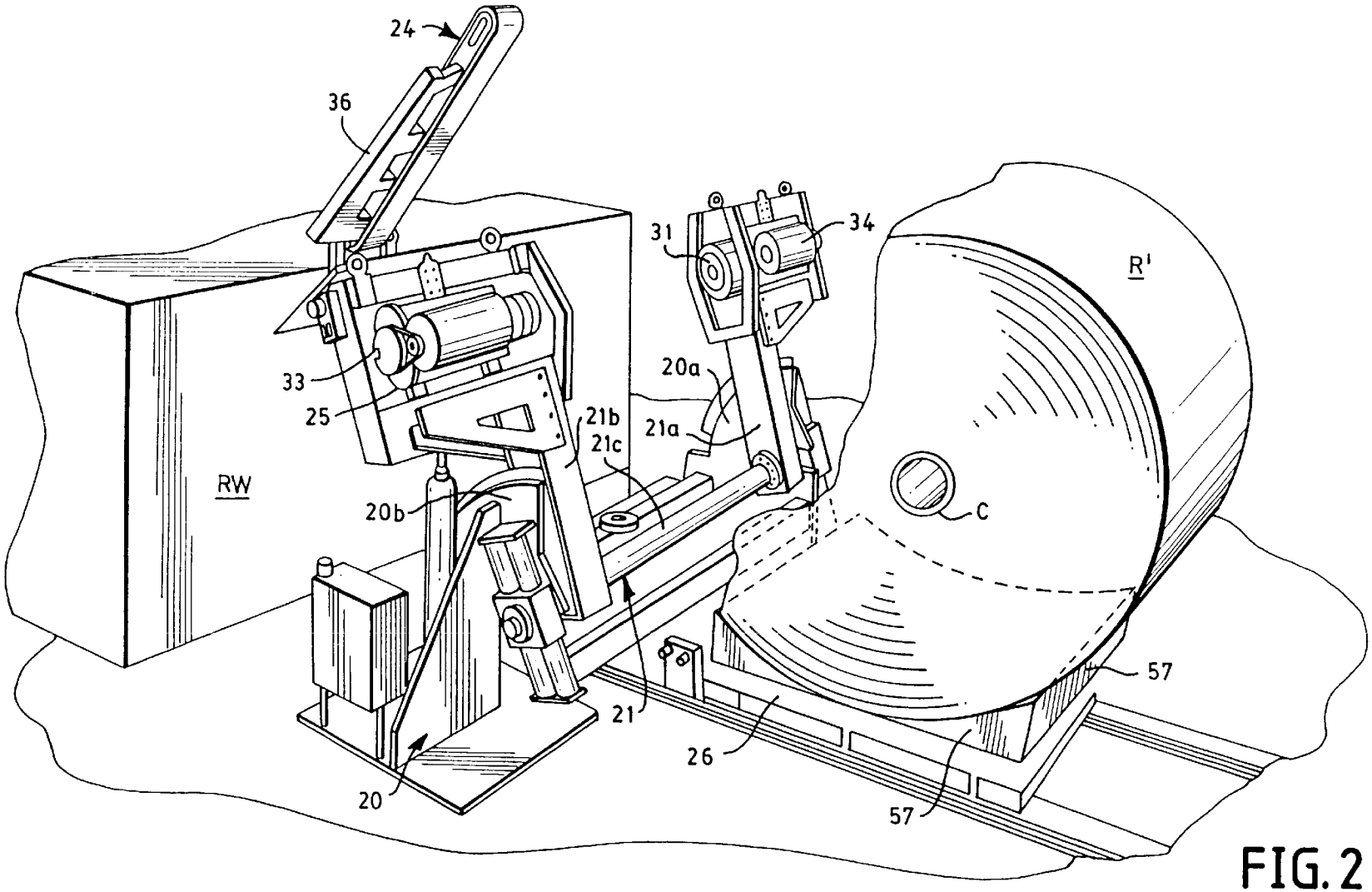
FIG. 2 is a perspective side elevational view of the unwind operation of FIG. 1 as seen from the upstream drive side, i.e., the side opposite the operator side, wherein upstream refers to the start of the path or stream of the web and downstream refers to the direction of the rewinder.

Referring now to FIGS. 1 and 2, a frame 20 for the unwind stand includes a pair of side frames 20*a* and 20*b*, the latter depicted in the central portion of FIG. 2. The frame 20 pivotally supports essentially U-shaped arm means 21. An arm 21*a* is positioned on the operating side. An arm 21*b* is positioned on the drive side. A transverse member 21*c* interconnects the two arms and makes the two arms rigid.

Figure 3:
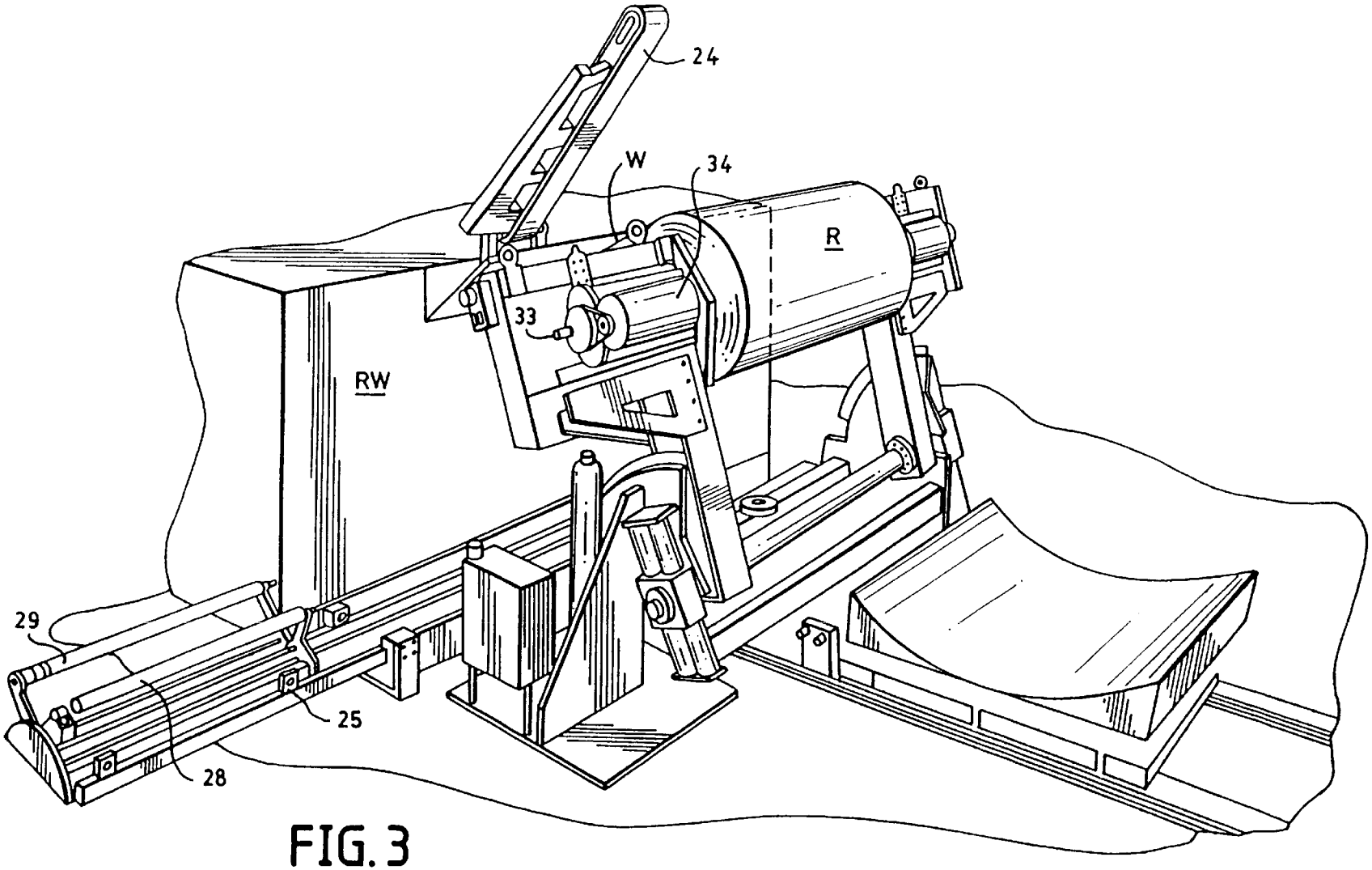
FIG. 3 is a perspective view of an unwind operation slightly more downstream from FIG. 2 and showing the unwind in the middle of an unwind cycle.
Figure 4:
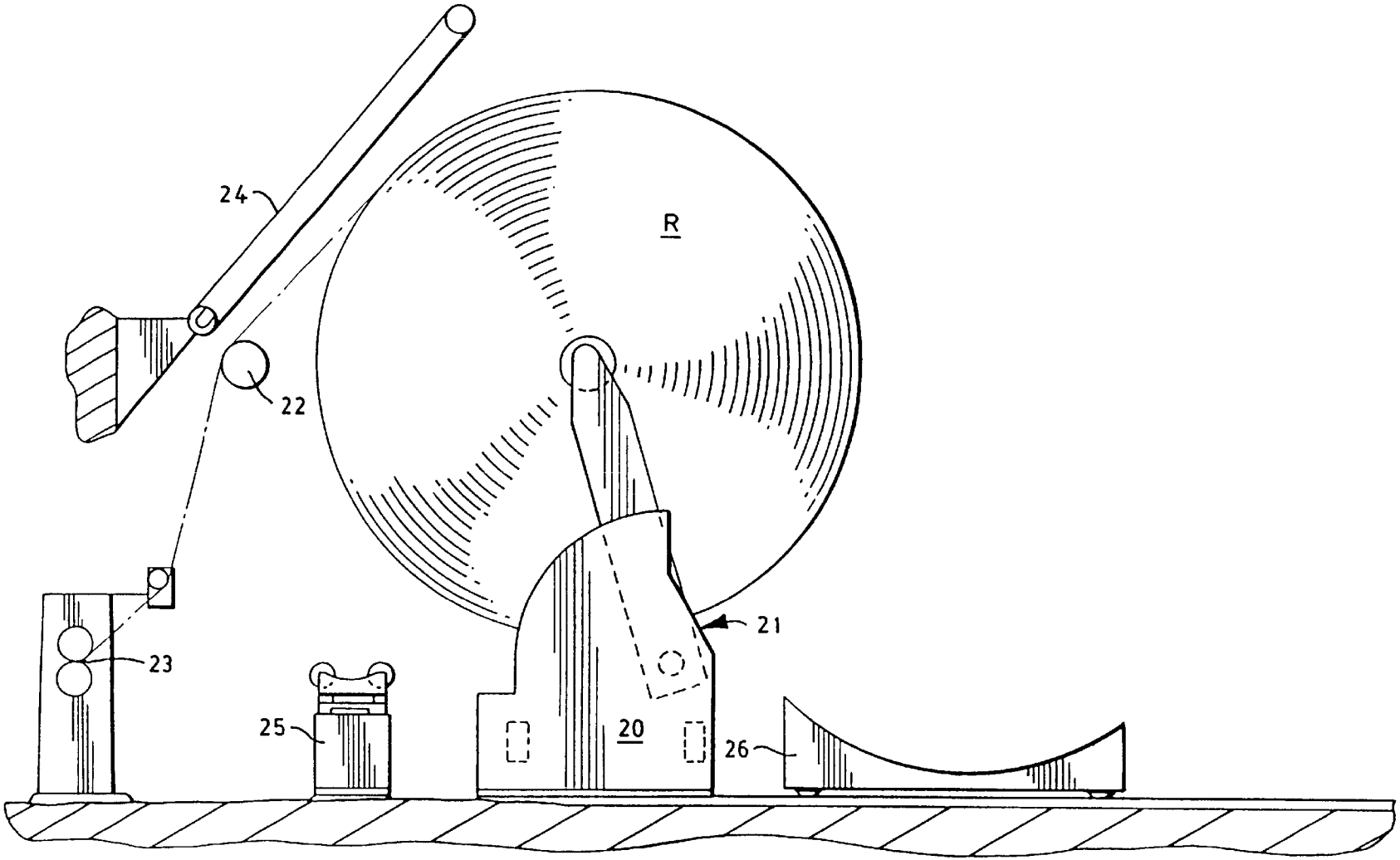
FIG. 4 is a schematic side elevational view corresponding to the perspective view of FIG. 3 and showing a full roll at the start of the unwinding cycle.

The arms 21*a* and 21*b* support a parent roll R (FIGS. 3 and 4) in the process of being unwound to provide a web W. The web W proceeds over a roller 22 (in the center left of FIGS. 1 and 4) and into a bonding unit 23. See also FIG. 5. A roller 22 may be an idler or driven roller.

Other elements depicted in FIGS. 1–4 are a thread-up conveyor 24, a core placement table 25, and a means 26 such as a cart for supporting a parent roll R' subsequently to be unwound (FIGS. 1 and 2). In FIG. 2, a core C is depicted. At the extreme left in FIGS. 2 and 3, a rewinder RW is depicted at the downstream end of the operation.

A sequence of operation is depicted in FIGS. 1 and 6–11.

Figure 14:
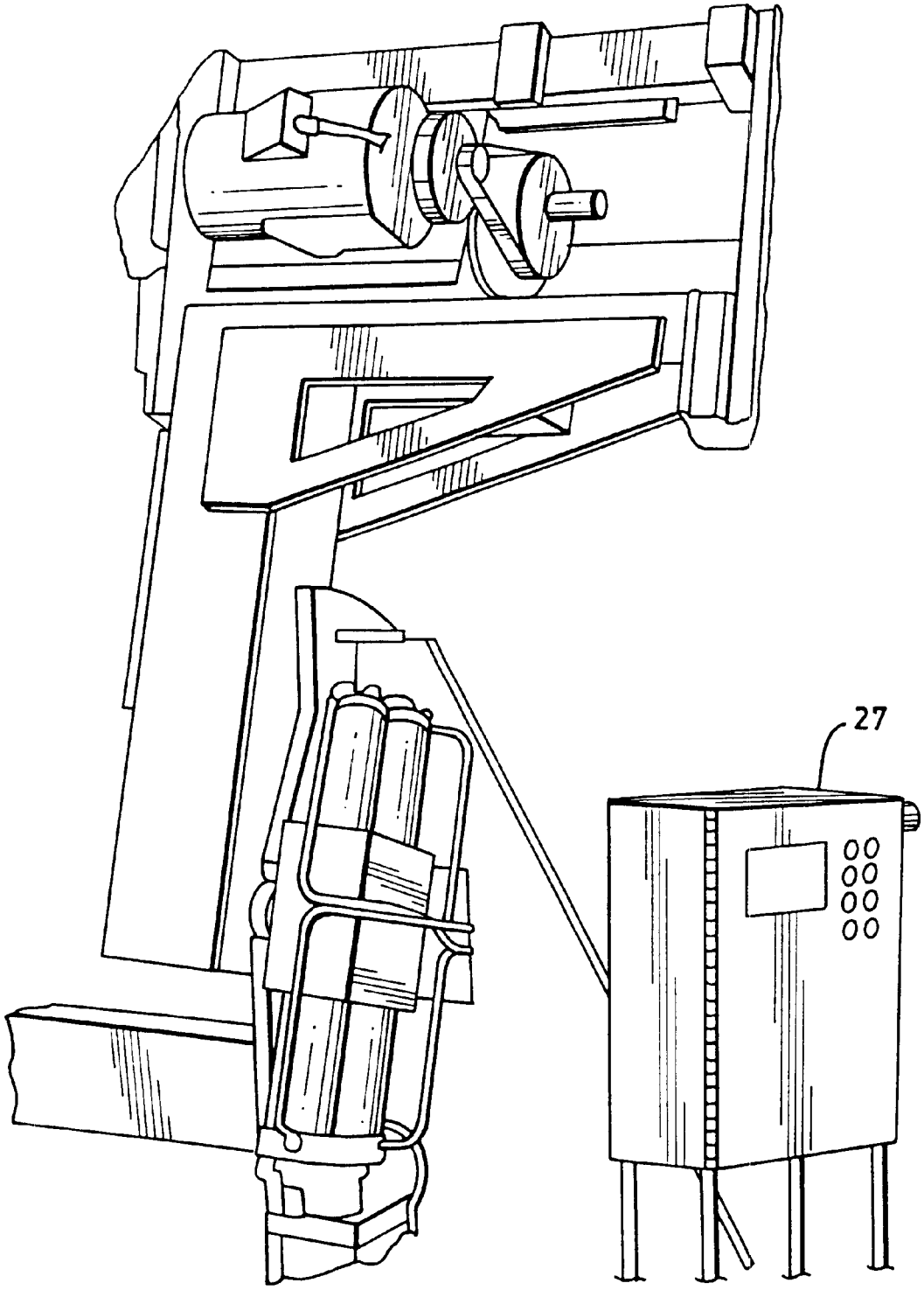
FIG. 14 is a fragmentary perspective view from the operator side of the unwind operation and featuring the control means.

In FIG. 1, with the machine running and the diameter of the parent roll R decreasing, a deceleration diameter is calculated by a control means 27 depicted in FIG. 14. In FIG. 2, the control means 27 is partially obscured by the side frame 20*a*.

When the parent roll diameter reaches the determined diameter, the unwind and associated equipment begin decelerating. During the decelerating time, the core placement table 25 is aligned with the web center line of FIG. 2, the core placement table 25 having been previously in the standby position of FIG. 3.

Figure 6:
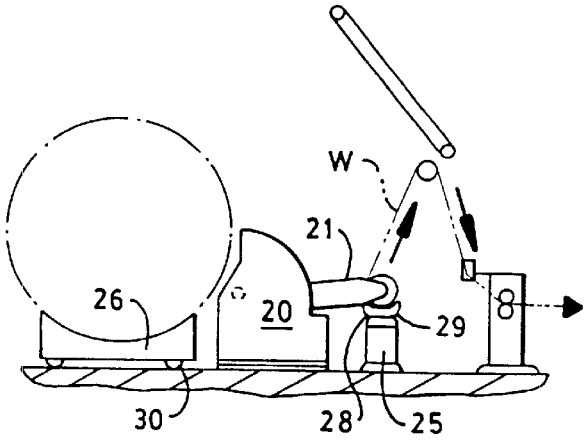
FIG. 6 is a schematic side elevational view of an unwind operation from the operator side and showing the condition of the apparatus as a parent roll is almost completely unwound, i.e., slightly later in the operational sequence from of the unwind operation of FIG. 1.

In FIG. 6, when all machine sections reach zero or a reduced speed and the core table 25 is confirmed empty, the core placement position of the arm means 21 is calculated which will set the expired parent roll $R_x$ slightly above or lightly on the cradle rollers 28, 29 of the core table 25. One of the cradle rollers 28 is driven, while the other is an idler.

The arm means 21 then is pivoted toward the calculated position, as shown in FIG. 6. As the arm means 21 moves under the signal from the control means 27, the web W is unwound to prevent web breakage. The parent roll cart 26 (FIG. 6) is moved into the unwind loading position.

The cart movement is based on previous roll diameter, measured diameter, or an assumed diameter. The previous roll diameter is that of the last parent roll when loaded. The assumed new parent roll has the same diameter, and the position of the "old" roll is the one selected for the "new" roll. The "measured" diameter is actually measured, either mechanically or manually. The "assumed" diameter is a constant value selected by the operator which is used repeatedly as coming near the actual diameter. The preposition of the cart minimizes subsequent moves which frustrate the achievement of a one-minute or less roll change. The cart movement is under the control of the control means 27. The object of the novel unwind of the present invention is to have its operation automatic, for both safety and efficiency.

The cart 26 moves into the position shown in the unwind along either the machine directional axis or the cross directional axis. The cart 26 is shown moving along the machine direction a la wheels 30 in FIGS. 6–13.

When the arm means 21 reaches the core drop position relative to the core table 25 as shown in FIG. 6, the core chucks 31 (FIG. 5) are contracted by control means 27 which allows both of the core chucks 31 (FIG. 2) to be fully retracted out of the core C (FIGS. 6 and 7), and the expired parent roll $R_x$ is placed onto the core table 25. The control means 27 is a Model PIC 900 available from Giddings and Lewis, located in Fond du Lac, Wis.

Figure 7:
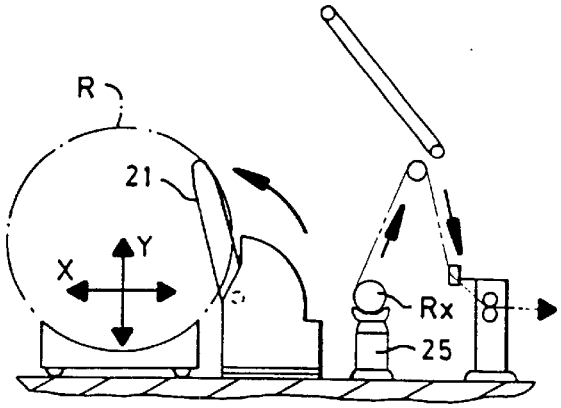
FIG. 7 is a sequence view showing the beginning of the provision of a new parent roll.

In FIG. 7, as the arm means 21 moves toward a new position, photoelectric sensors 32 (FIG. 5) mounted on the arm means 21 detect the edge of the parent roll loaded into the parent roll cart. When each sensor detects a parent roll edge, the angular position of the arm means 21 is recorded by the control means 27. Each data point along with known geometries and cart X-Y coordinates (arrows in FIG. 7) calculates parent roll diameter and estimates X-Y coordinates of the center of the core C. Based on the core coordinates, the parent roll cart 26 is repositioned.

With the parent roll R repositioned and arm means 21 moving toward the parent roll loading position, the sensors 32 mounted on the arm means 21 (FIG. 5) detect the leading and trailing edge of the core. As each sensor 32 detects an edge, the angular position of the associated pivot arm is recorded in the control means 27.

The data together with known geometries calculate multiple X-Y coordinates of the center of the core. Coordinates are calculated separately for each end of the core. Averaging obtains core coordinates for each end of the core.

The parent roll cart 26 is repositioned to align the center of the core C and core chucks 31. If the cross directional axis of the core is aligned properly with the cross directional axis of the cart 26, both the core chucks 31 extend into the core C, and the chucks expand to contact the core. The expansion and contraction of the chuck means 31 are achieved by internal air operated bladders or other actuating means under signal from the control means 27. Air is delivered through a rotary union 33, shown in the central portion of FIG. 3.

Figure 8:
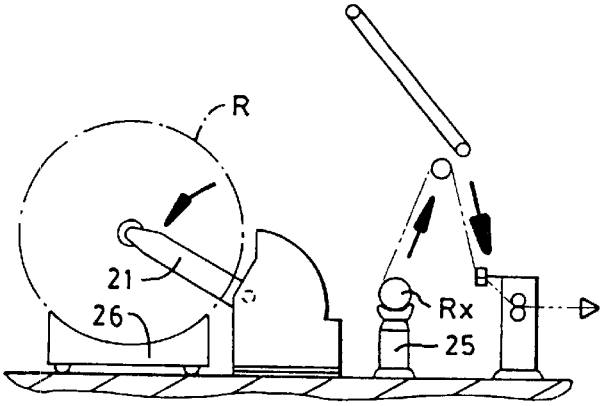
FIG. 8 is a view of the apparatus in its condition slightly later than that shown in FIG. 7.

FIG. 8 shows the arm means 21 in the loading position. If core skewing is excessive, the alignment of the parent roll core and core chucks is performed individually on each end of the core. First, the arm means 21 and the parent roll cart 26 are positioned so that one chuck 31 extends into the core C. When in the core, the first chuck expands. Next, the parent roll cart 26 and/or arm means 21 are repositioned to align the remaining core chuck 31 with the core C. When aligned, the second core chuck 31 extends and expands.

When fully chucked, the parent roll R is lifted slightly out of the cart 26. Then, the parent roll is driven, i.e., rotatably, by motors 34 (FIGS. 2 and 5) which drive the chucks 31. Using motors on each arm evenly distributes the energy required. Sufficient torque is applied by the core chuck drive motors 34 to test for slippage between a core chuck 31 and the core C. If slippage is detected, the parent roll is lowered back into the cart 26. The core chucks are contracted, removed from the core, and repositioned, i.e., "loaded" into the core. The core slippage test then is repeated. Multiple failures of the core slippage test results in an operator fault being issued.

Figure 9:
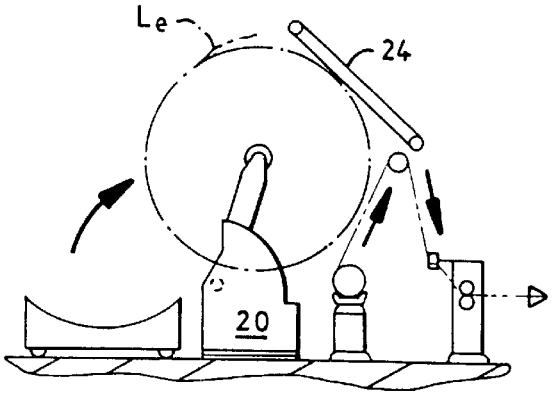
FIG. 9 is a view of a fully wound parent roll installed in the unwind.

In FIG. 9, if no slippage is detected, arm means 21 are moved to the winding position, i.e., upright. As shown by FIG. 9, with the arm means in the run position, the vacuum thread up conveyor 24 is lowered into close proximity to contact the parent roll, and the vacuum is activated. The core chuck drive motors 34 rotate the parent roll R. The thread-up conveyor 24 operates at the same surface speed as the parent roll surface speed.

Figure 10:
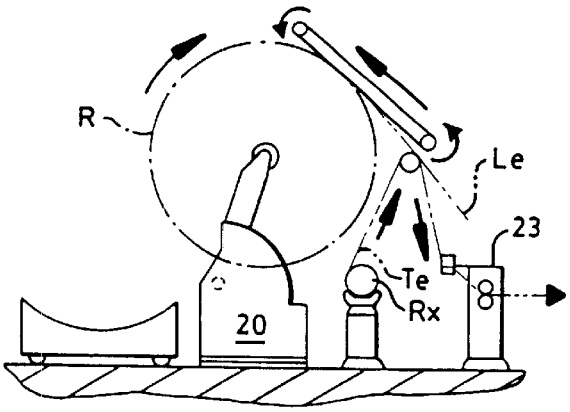
FIG. 10 is a view of apparatus in a condition for coupling the leading edge portion of a new parent roll to the trailing tail portion of an almost expended parent roll.

Referring now to FIG. 10, when the leading end $L_e$ of the web on the parent roll R comes into contact with the vacuum conveyor 24, the tail is sucked up and pulled along by the vacuum thread up conveyor.

When the discharge end of the vacuum thread-up conveyor 24 is reached, the new web end portion $L_e$ drops onto the trailing end portion $T_e$ of the web from the expired parent roll $R_x$ depicted by FIG. 10. The rest of the machine line including the driven roller 28 now is brought up to match speed with that of the unwind.

Figure 11:
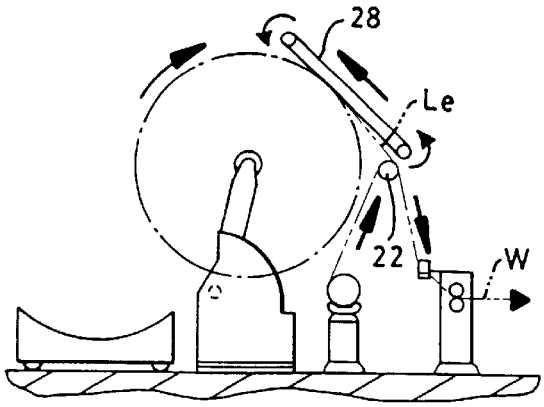
FIG. 11 is a view showing two webs in the process of being bonded together.

In FIG. 11, the new web is carried through the line with the web from the expired roll. The two webs then are joined together as at W in FIG. 11. An embossing-type method 23 is used. After combining the webs, the web from the expired parent roll is no longer needed and brake means associated with the core table or roller 28 stops the expiring parent roll from turning and thus breaks the expired web. Vacuum is removed, and the vacuum thread-up conveyor is raised. The unwind now returns to previous running speeds. As the machine accelerates, the parent roll cart 26 is returned to its loading position for another roll, and the core table is retracted to allow for core removal.

The control means 27 performs a number of functions. First, in combination with the parent roll cart means 26, the control means 27 calculates diameter and determines the position of the core C for positioning the cart means for insertion of the chuck means 31 into the parent roll core. Further, the control means 27 includes means cooperating with the sensor means 32 for calculating the coordinates of the parent roll core and averaging the coordinates prior to insertion of the chuck means 31. Still further, the control means includes further means for comparing the alignment of the core cross-directional axis with the parent roll cross-directional axis.

Figure 5:
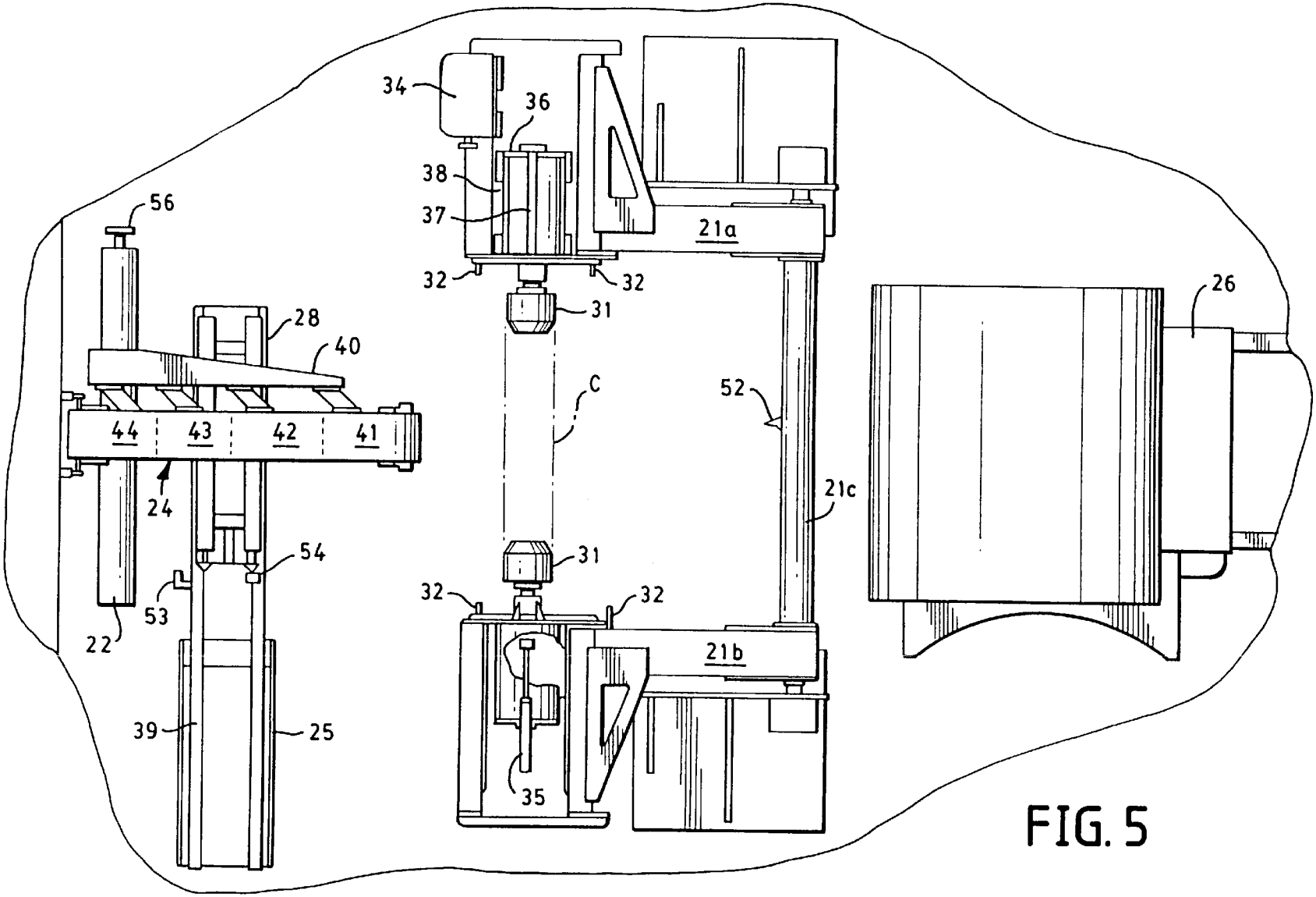
FIG. 5 is a top plan view of an unwind operation with a cut away view to show a hidden cylinder.

When all is aligned, the control means 27 operate the chuck means 31 for insertion into the core C by actuation of the cylinders 35 (FIGS. 2 and 5). The control means 27 further cause expansion of the chuck means 31 to clamp internally the tubular core C. Relative to the insertion of the chuck means 31, the drive shaft of each motor 34 is offset from the axis of the associated chuck means 31 as in the left central part of FIG. 2 and the upper part of FIG. 5. The motor 34 is connected by a drive 36 to the shaft 37 of the chuck means 31. The shaft 37 is supported rotatably in the housing 38 of the chuck means 31. As in the upper part of FIG. 5, the motor 34 is offset from the shaft 37. As in the lower part of FIG. 5, the cylinder 35 moves the housing 38 and the chuck means 31 into engagement with the core C.

The control means 27 also calculates the deceleration diameter of the roll R being unwound, confirms the emptiness of the core table 25, and operates the arm means 21.

Referring to FIG. 5, the core placement table 25 is mounted in rails 39 for removal during the unwind cycle. If a web break occurs, the core placement table 25 is out of the web path so as not to interfere with clean-up. The thread-up conveyor 24 includes a vacuum manifold 40 providing a plurality of vacuum stages as at 41, 42, 43, and 44 of gradually less vacuum. The conveyor 24 of screen or mesh construction facilitates pickup of the leading edge portion of the web from the "new" parent roll.

A leading end portion is folded to provide a triangular shape to facilitate taping down. The triangular shape prevents inadvertent detachment of the leading edge portion from the underlying ply during transfer of the parent roll from the paper machine to the site of rewinding. The first log rewound from a new parent roll is discarded and eliminates a lumpy transfer.

In operation of the unwind under the control of the control means 27, the conveyor 24 and vacuum from a pump are both shut down to conserve energy and avoid unnecessary noise.

Figure 12:
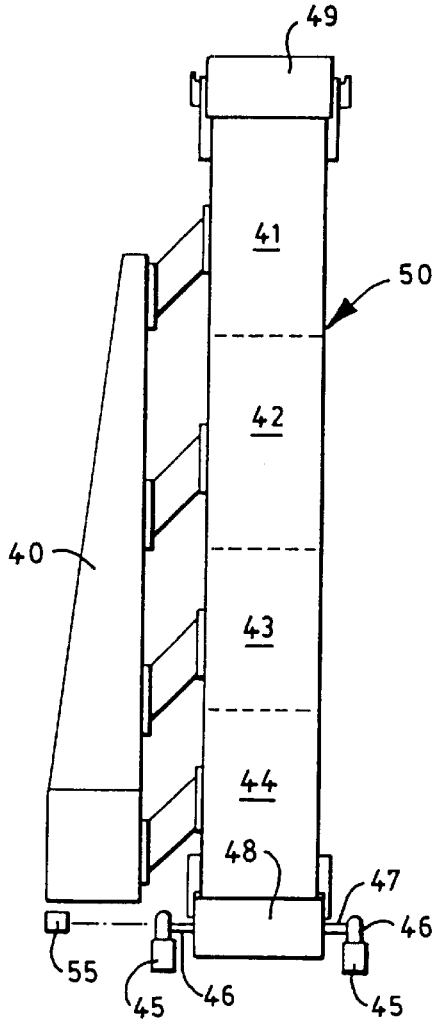
FIG. 12 is a top plan view of the thread-up conveyor.
Figure 13:
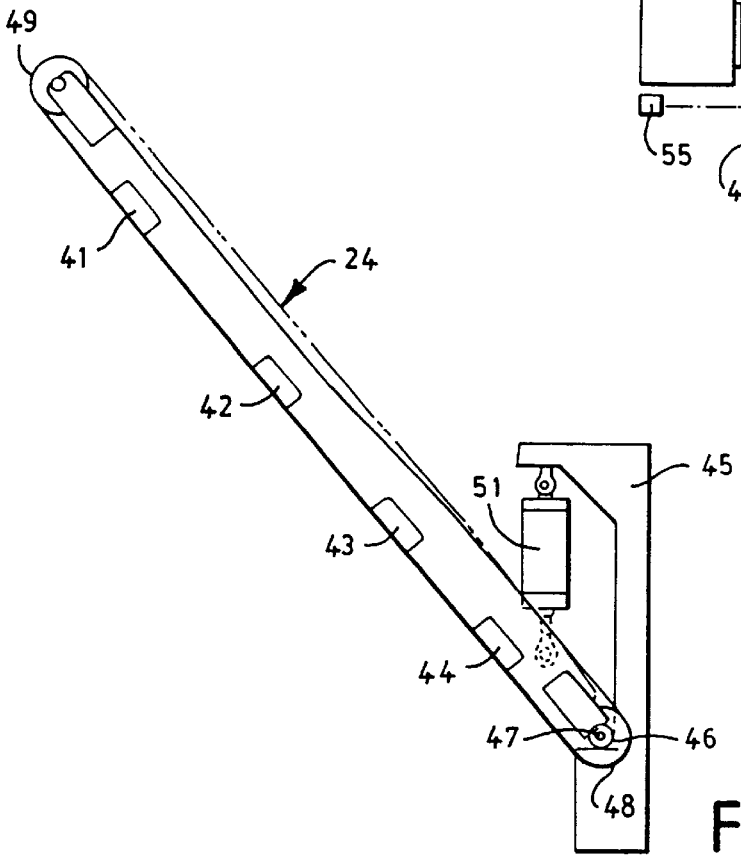
FIG. 13 is a side elevational view of the conveyor of FIG. 12.

The thread-up conveyor 24 is supported pivotally on a pair of pedestals 45 (right lower portion of FIG. 13) providing a mounting 46 for each side of the conveyor 24 (FIG. 12). The mountings 46 rotatably carry a cross shaft 47 on the axis of the lower driving roller 48. At its upper end, the conveyor 24 has an idler roller 49 supported on the staged chamber 50 coupled to the manifold 40.

Positioning of the conveyor 24 by hanging its angle is achieved by a pair of pressure cylinders 51 coupled between the pedestals 45 and the chamber 50. The cylinders 51 are under the control of the control means 27.

The control means 27 calculates the deceleration diameter near the end of the unwind cycle, and a further sensor 52 is provided on the transverse member 21*c* of arm means 21, as seen in FIG. 5. The sensor continually reports the radius of the parent roll, and the control means continually calculates the motor speed to obtain a preferred unwind. Alternatively, process feedback such as load cells or dancers are used to report to the control means changes in tension and enable the control means to vary the motor speed.

When the rewinder is located, as a primary consideration because of its involvement with the core hopper, core feed, log removal, and log saw, the unwind frame 20 is placed a preferred distance upstream to accommodate the core placement table 25, the thread-up conveyor 24, and any bonding unit 23.

The location of the core placement table 25 is a function of the pivot geometry of the arm means 21 as shown in FIG. 6.

The location of the thread-up conveyor 24 is a function not only of the arm means geometry but also the size parent rolls to be unwound.

In a similar fashion to the location of the core table 25, the cart 26 is placeable to have the parent roll engageable by the chucks 31 of the arm means 21.

The unwind operation, although having a means for actually rotating the parent roll, includes a path or section of a mill's converting area extending from the cart means 26 which provides the next parent roll, all the way to the rewinder proper.

The unwind operation includes significant structural features. The unwind operation provides the roll cart means 26 operably associated with the frame 20 for supporting a "new" parent roll R', the roll cart means 26 cooperating with the control means 27 for positioning the chuck means 31 and inserting the same into a parent roll core C.

Further, the control means 27 includes sensor means 32 cooperatively coupled together for calculating the coordinates of the "new" parent roll R' and averaging the coordinates prior to insertion of the chuck means 31.

Still further, the control means 27 includes the capability to compare the alignment of the core cross directional with the parent roll cross directional axis. The control means capability also includes the controlling of the insertion of the chuck means 31 into the core C by, for example, controlling the operation of the fluid pressure cylinders 35.

Near the end of the unwinding cycle, the control means 27 regulate the pivotal movement of the arm means 21 as a function of the degree of unwinding of the parent roll R. Also during the unwinding cycle (during its last stages), the control means 27 in combination with sensing means 53 determines the condition of the core placement table 25 (left center portion of FIG. 5).

Near the very end of the unwinding cycle, it is important for the core placement table to be in position to receive the almost-expired roll Rx, to be free of any obstructing material, and also to have its rotating roller 28 in operation. But at the very end, the motor and brake means 54 operably associated with the roller 28 are energized to snap off the web W with a minimum of web tail retained on the table 25, optimally about ¼" (6 mm).

Prior to the very end, but toward the end of an unwinding cycle, the control means actuates the thread-up conveyor 24 via a drive 55 (lower left of FIG. 12). The drive 55 is coupled to the drive 56 of the driven roller 22 (FIG. 5) which is driven by a motor. Actuation of a vacuum pump applies a reduced pressure to the manifold 40.

The novel method and unwind operation for large diameter parent rolls is completely automated to avoid the need for manual handling of cumbersome and potentially dangerous rolls. At the outset, the cart 26 is equipped with an upper table 57 (FIG. 2) which is rotatable about a vertical axis through an arc of 90° to permit cantilever delivery of a new parent roll having an axis parallel to the length of the web path, i.e., from cart 26 to bonding station 23. The controller 27 causes the table 57 to rotate to the position shown in FIGS. 2 and 3 for commencing the unwind cycle. As the previous parent roll nears expiration, the arm means 21, detached from the previous roll core, are pivoted automatically from downstream to upstream, and the chucking of the core is performed automatically. Then at the end of the cycle, the depleted core is deposited on the table 25, and the arm means 21 is unchucked for the initiation of another cycle.

Figure 15:
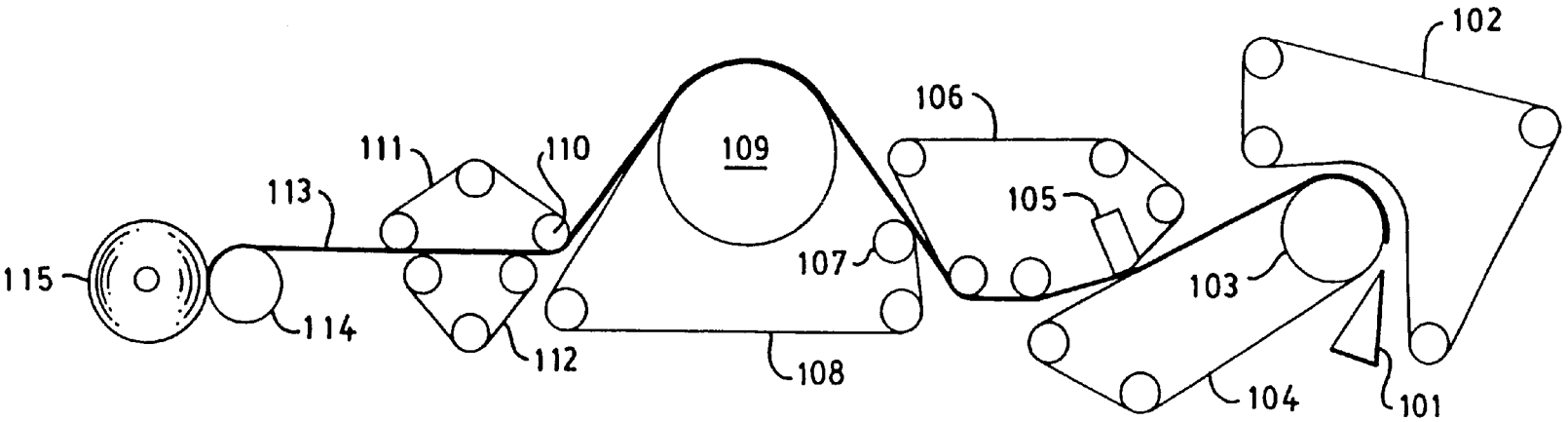
FIG. 15 is a partial schematic process flow diagram for a method of making a tissue web and, in one aspect, an uncreped tissue web.

Referring now to FIG. 15, a method of carrying out the present invention will be described in greater detail. FIG. 15 describes a process for making a tissue web, and preferably an uncreped throughdried base sheet. Shown is a twin wire former having a layered papermaking head box 101 which injects or deposits a stream of an aqueous suspension of papermaking fibers onto a forming fabric 102. The resulting web then is transferred to a fabric 104 traveling about a forming roll 103. The fabric 104 supports and carries the newly formed wet web downstream in the process as the web is partially dewatered to a consistency of about 10 dry weight percent. Additional dewatering of the wet web can be carried out, such as by differential air pressure, while the wet web is supported by the forming fabric.

The wet web then is transferred from the fabric 104 to a transfer fabric 106 traveling at a slower speed than the forming fabric to impart increased MD stretch into the web. A kiss transfer is carried out to avoid compression of the wet web, preferably with the assistance of a vacuum shoe 105. The web then is transferred from the transfer fabric to a throughdrying fabric 108 with the aid of a vacuum transfer roll 107 or a vacuum transfer shoe. The throughdrying fabric can be traveling at about the same speed or a different speed relative to the transfer fabric. Throughdrying fabric can be run at a slower speed further to enhance MD stretch. Transfer preferably is carried out with vacuum assistance to ensure deformation of the sheet to conform to the throughdrying fabric, thereby yielding preferred bulk, flexibility, CD stretch, and appearance.

The level of vacuum used for the web transfers are from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. A vacuum roll or rolls can be used to replace the vacuum shoe(s).

While supported by the throughdrying fabric, the web is final dried to a consistency of about 94 percent or greater by a throughdryer 109 and thereafter transferred to an upper carrier fabric 111 traveling about roll 110.

The resulting dried base sheet 113 is transported between upper and lower transfer fabrics 111 and 112, respectively, to a reel 114 where it is wound into a parent roll 115 for subsequent unwinding, possible converting operations, and rewinding. For the tissue making portion of the present invention, the forming process and tackle include Fourdrinier, roof formers such as a suction breast roll, gap formers such as twin wire formers, and crescent formers. A twin wire former is preferred for higher speed operation. In respect to the forming wires or fabrics, the finer weaves provide greater fiber support and a smoother sheet. The coarser weaves providing greater bulk. Head boxes are used to deposit the fibers onto the forming fabric and are layered or nonlayered. Layered head boxes are advantageous because the properties of the tissue are finely tuned by altering the composition of the various layers.

Figure 16:
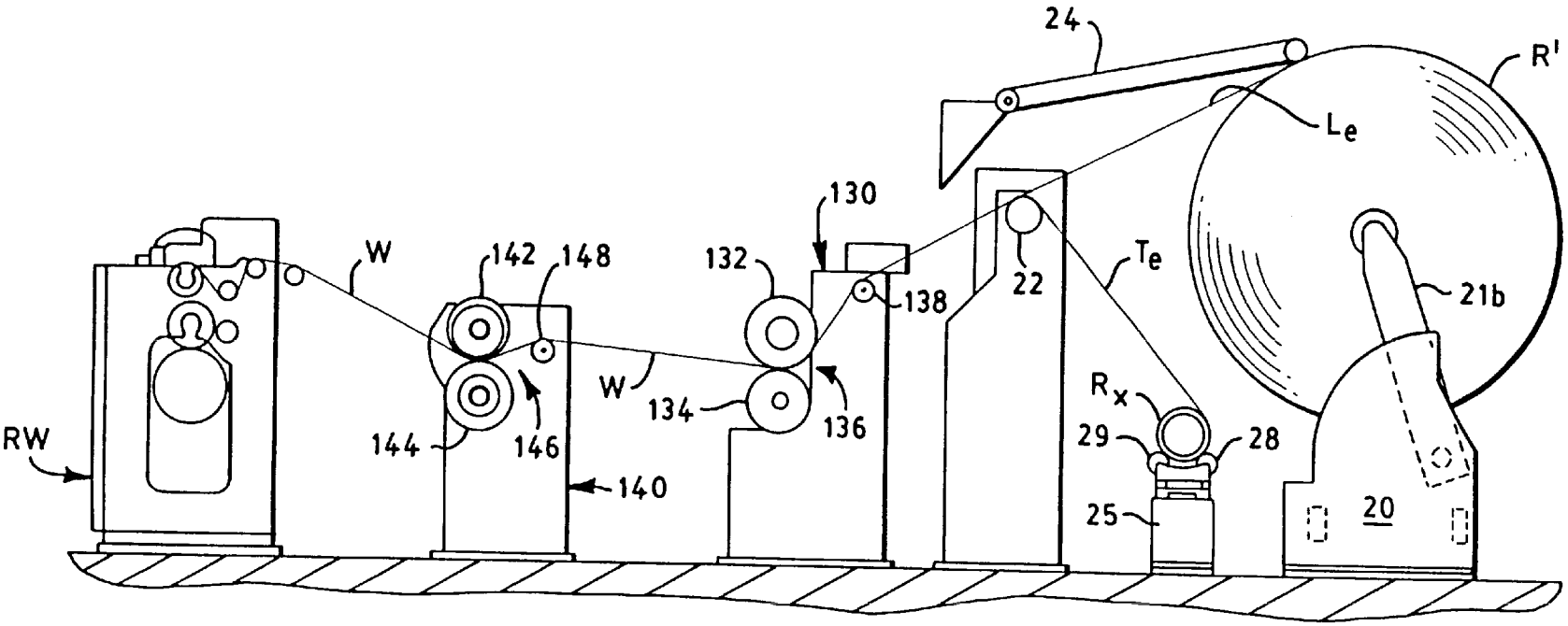
FIG. 16 is a partial schematic process flow diagram illustrating a method of splicing webs together utilizing a finishing unit.

Referring now to FIG. 16, an automated off-line method splices tissue webs from different parent rolls for subsequent rewinding. The method includes a finishing unit forming substantially continuous impacts on each web during unwinding to form the splice between the webs. An expiring roll $R_x$ has been deposited on the core placement table 25. The web W from the expiring roll $R_x$ preferably is transported in sequence to a calendering unit 130 and an embossing unit 140. Either the calendering unit or the embossing unit forms substantially continuous impacts on the web W during the time that the web is unwound from its parent roll $R_x$. The calendered and embossed tissue web W then is wound at a rewinding unit RW. For example, the tissue web W is wound onto tissue roll cores to form logs, which are subsequently cut into appropriate widths and the resulting individual tissue rolls are packaged.

The calendering unit 130 includes a pair of calendering rolls 132 and 134 that together define a calendering nip 136. A spreader roll 138 is shown preceding the calendering nip 136.

The calendering nip 136 includes a "soft-nip" wherein the rolls have different surface hardness and at least one of the rolls has a resilient surface. Resilient calendering rolls in the present invention are rubber covered calendering rolls, including natural rubber, synthetic rubber, composites, or other compressible surfaces. Suitable resilient calendering rolls have a Shore A surface hardness from about 75 to about 100 Durometer (approximately 0 to 55 Pusey & Jones), and preferably from about 85 to about 95 Durometer (approximately 10 to 40 Pusey & Jones). The calendering rolls include a smooth steel roll 134 and a smooth resilient roll 132 formed of a composite polymer such as that available from Stowe Woodward Company, U.S.A., under the trade name MULTICHEM. The calendering nip pressure is from about 30 to about 200 pounds per lineal inch and more preferably from about 75 to about 175 pounds per lineal inch.

Upon exiting the calendering unit 130, the tissue web W is transported to an embossing unit 140 including a pattern roll 142 and a backing roll 144. The pattern and backing rolls 142 and 144 together define an embossing nip 146. A spreader roll 148 precedes the embossing nip 146.

Embossing increases sheet caliper and provides an additional benefit by imparting a decorative pattern to the tissue product. The decorative patterns include "spot embossing" or "spot embossments" which have discrete embossing elements. Embossing elements are about 0.5 inch by 0.5 inch to about 1 inch by 1 inch in size, and from about 0.25 to about 1 square inch in surface area. The discrete embossing elements are spaced about 0.5 inch to about 1 inch apart. The spot embossing elements are formed on a pattern roll, embossing roll, and are pressed into the tissue sheet. The spaced-apart discrete spot embossing elements form substantially continuous impacts on the web as it is processed through the embossing nip 146. The spot embossing elements depict a decorative pattern such as flowers, leaves, birds, animals, and the like. High-bulk tissue products are embossed with pattern clarity by processing the high bulk tissue webs sequentially through separate calendering and embossing units.

The backing roll 144 includes a smooth rubber covered roll and an engraved roll such as a steel roll matched to the pattern roll. The embossing nip is set to a pattern/backing roll loading pressure from about 80 to about 150 pounds per lineal inch, for example an average of about 135 pounds per lineal inch, such that the embossing pattern is imparted to the tissue web W. The backing roll material meets the process requirements such as natural rubber, synthetic rubber, or other compressible surfaces, and has a Shore A surface hardness from about 65 to about 85 Durometer, such as about 75 Durometer.

A new parent roll R' is shown in FIG. 16 automatically threaded into the finishing line. The new parent roll is rotated through the core chucks 31 mounted on the arms 21 and connected to the frame 20. The leading end $L_e$ of the new web has been transported by the thread-up conveyor 24 and deposited onto the trailing end portion $T_e$ of the nearly expired web W. The web W from the expiring roll $R_x$ preferably passes over a roller 22 and follows a downward path to the first finishing unit. The leading end $L_e$ of the new web then is deposited onto the nearly expired web W at the location of the roller 22 or downstream of the roller 22 to facilitate travel of both webs to the first finishing unit. The thread-up conveyor 24 preferably is operated in conjunction with rotation of the core chucks 31 and rotation of the roller 22. The roller 22 preferably is a driven roller with a high frictional cover, formed of loop material as used in engaging hook-and-loop materials.

The webs from both the expiring roll $R_x$ and the new roll R' are transported to the first finishing unit, the calendering unit 130. The webs are not bonded together prior to the calendering unit 130, and as a result the webs are moveable relative to one another upstream of the calendering unit. The process for splicing the webs together automatically involves simultaneously unwinding both webs from their respective parent rolls and simultaneously passing both webs through the finishing unit nip 136 to bond the webs together. In the illustrated embodiment, the parent rolls $R_x$ and R' are driven simultaneously by the cradle roller 28 and the core chucks 31. The web from the expiring roll $R_x$ is broken, and the new web receives substantially continuous impacts by the calendering unit or the embossing unit while the web is unwound.

The present method of splicing webs together from different parent rolls using the first finishing operation eliminates the need for separate bonding units and eliminates the need for external bonding means such as glue or tape. The novel method of the present invention replaces manual methods such as threading each new web or tying webs together.

In the illustrated embodiment, the first finishing operation is the calendering unit, which is used substantially continuously while the tissue webs are unwound. The first finishing operation after the unwind alternatively is an embossing unit, a crimping unit, or other such device that forms impacts on each individual tissue web while it is being unwound and bonds the overlapping webs together during a web splice such that the webs are held together to the rewinder. The method dramatically reduced the down time associated with splicing different parent roll webs together compared to prior methods.

Figure 18:
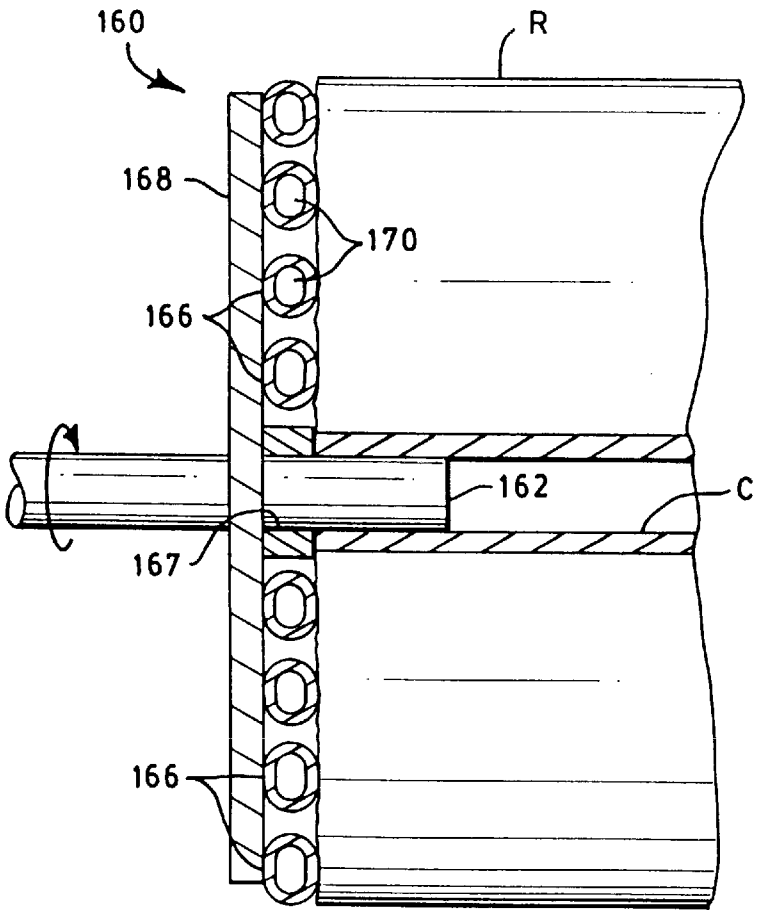
FIG. 18 is a partial longitudinal section view illustrating an alternative torque transfer means employing a plurality of inflatable bladders.
Figure 17:
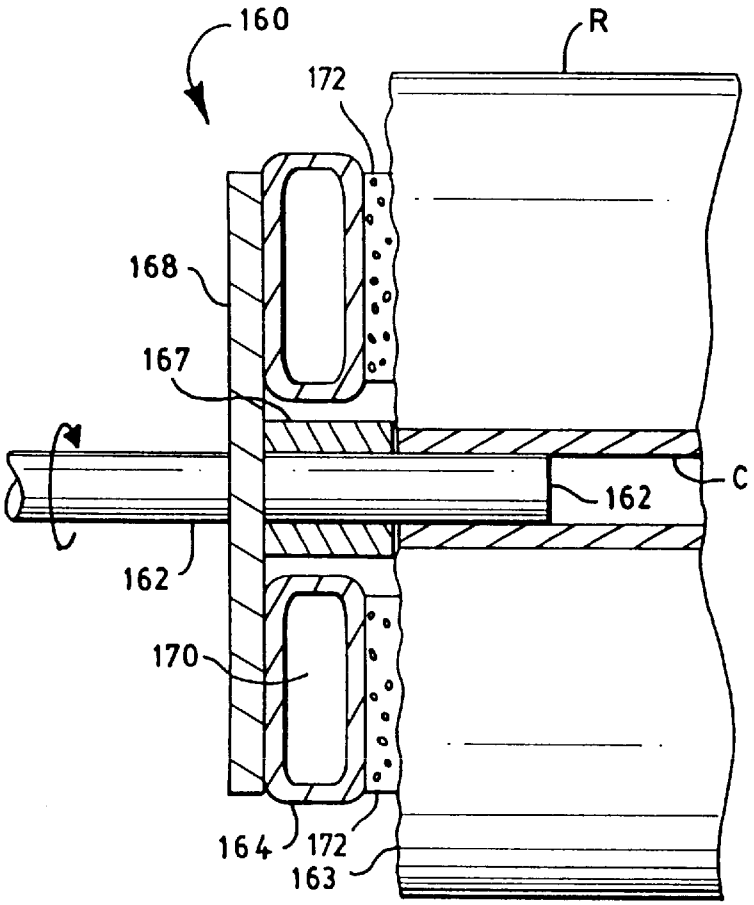
FIG. 17 is a partial longitudinal section view of a torque transfer means for transmitting torque from an unwind shaft through the roll via a side clamping mechanism and, in one aspect, an inflatable bladder.

In FIGS. 17 and 18, the torque transfer means include side clamping mechanisms that engage only the opposite end surfaces of the parent roll and sandwich the roll. Such side clamping mechanisms are used as the sole unwind devices or as supplemental devices in combination with a center-unwind drive. The torque transfer means 160 shown in FIGS. 17 and 18 are operable to transmit torque from an unwind shaft 162 through a parent roll R. The torque transfer means 160 apply pressure against the end surfaces 163 of the roll R using an inflatable annular bladder 164 (FIG. 17) or alternatively a plurality of inflatable annular bladders 166 (FIG. 18). The roll core C is positioned over the end of the shaft 162 and against a ring 167.

The inflatable bladders 164 and 166 are attached to a backing plate 168 fixedly attached to the unwind shaft 162. The bladders are inflated and deflated by the movement of a fluid though suitable conduits into bladder cavities 170. As a result, the inflatable bladders apply pressure to the end surfaces of the parent roll and deflate or retract as the parent roll unwinds. In FIG. 18, the annular bladders 166 are deflated or disengaged in series moving radially inward as the parent roll is unwound to smaller diameters so as not to interfere with the sheet as it is peeled away from the roll. The interior bladders 166 are left inflated to continue transmitting torque through the roll at smaller roll diameters. The bladder contact pressures against the ends of the parent roll depend on the configuration of the torque transfer means 160 and are less than about 2.5 pounds per square inch (psi), preferably about 0.5 to about 2.5 psi, and more preferably less than about 1 psi, to minimize damage to the tissue web.

In FIG. 17, a friction plate 172 is attached to the inflatable bladder 164 to engage the end surfaces 163 of the roll R upon inflation of the bladder 164. The friction plate 172 is formed of a material that grips the roll using minimal pressure and causes minimal damage to the edges of the sheet, although the end surfaces of the roll are not used to make finished tissue products.

The size of the backing plate 168 depends on the size of the parent rolls and is at least about 45 inches, such as about 45 to about 60 inches outside diameter, so as to be located where the highest forces are present. The portion of the torque transfer means 160 contacting the end of the roll has specified inner and outer diameters which minimize pressure on the roll, maximize contact area, and provide the preferred relationship between the contact area, engagement pressure, and friction characteristics of the torque transfer means.

Figure 19:
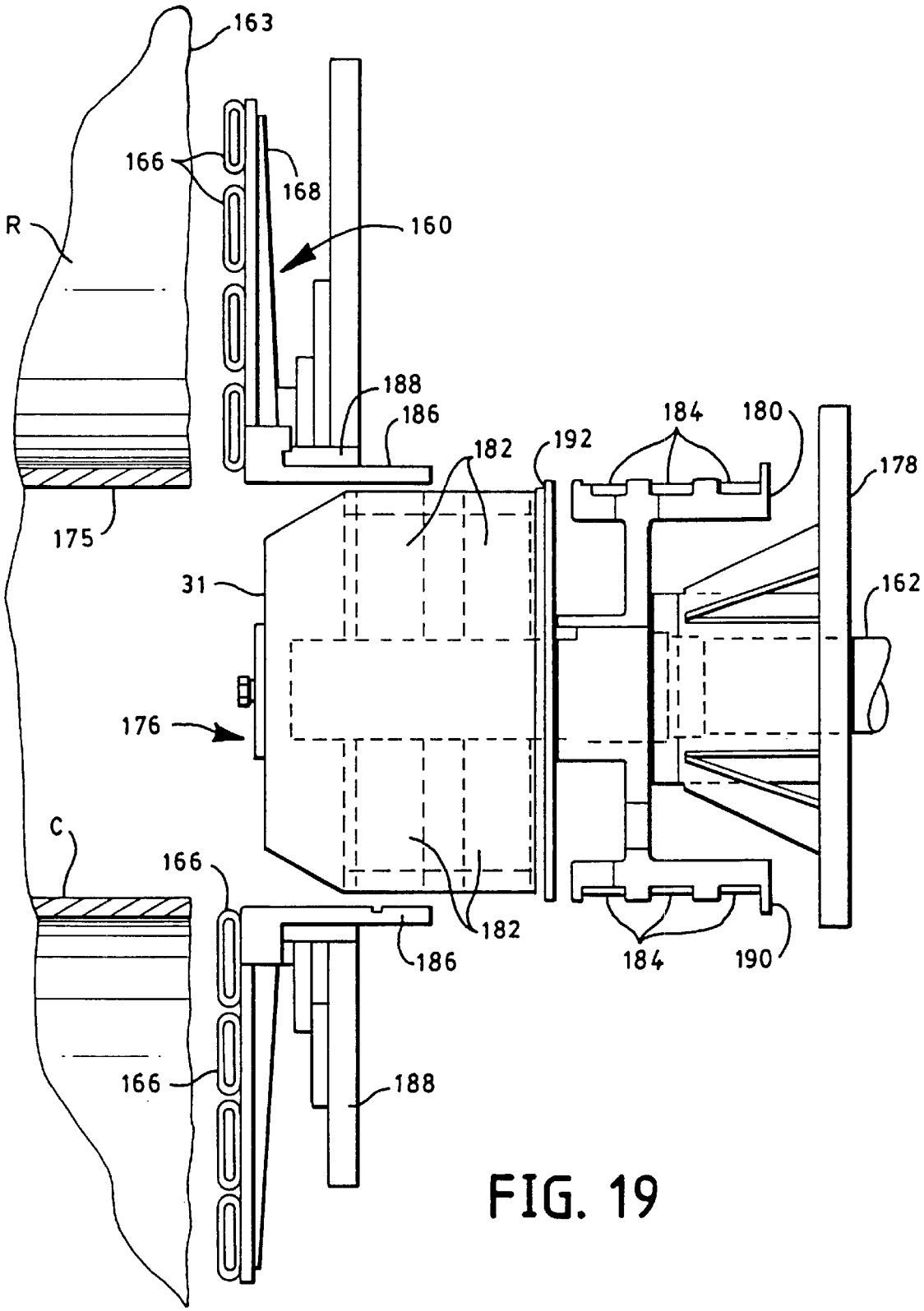
FIG. 19 is a partial longitudinal section view of an alternative torque transfer means with portions broken away for purposes of illustration.

The unwind operation partially illustrated in FIG. 19 combines core chucks 31 for engaging the inner surface 175 of the core C and supplemental torque transfer means 160 for engaging the end surfaces 163 of the parent roll R. The unwind operation includes opposed chuck shaft assemblies 176 (only one shown), each including an unwind shaft 162 rotatably mounted within a hub 178 and drivingly connected to a variable speed drive. Each chuck shaft assembly 176 also includes a core chuck 31 and a supplemental drive chuck 180, both of which are mounted on the shaft 162 to rotate with the shaft 162. The core chucks 31 include inflatable core chuck bladders 182 adapted to engage frictionally the inner core surface 175 when the chuck shaft assembly 176 is inserted into the core C. The supplemental drive chuck 180 includes inflatable coupling bladders 184. Conduits within the chuck shaft assembly 176 operably connect the cavities of the core chuck bladders 182 and coupling bladders 184 to a fluid source for inflating and deflating the bladders.

The supplemental torque transfer means 160 includes an annular backing plate 168. A plurality of concentric, inflatable annular bladders 166 are attached to the backing plate and adapted to engage the end surfaces 163 of a parent roll R, shown in close proximity to the chuck shaft assembly 176 for purposes of illustration. The backing plate 168 includes an integral, axially extending collar 186 releasably attached by spring balls and detents or other suitable means to a portion of the fixed frame 188. Conduits within the backing plate 168 and chuck shaft assembly 176 and connected by a rotary joint operatively connect the cavities of the annual bladders 166 to a fluid source.

When the core chucks 31 are aligned for insertion into a core C, the chuck shaft assemblies 176 are advanced axially toward one another into the roll R. Axial movement is halted temporarily when the supplemental drive chucks 180 are radially inward of the backing plate collars 186, and flanges 190 of the supplemental drive chucks 180 contact the collars. The coupling bladders 184 then are inflated to engage frictionally the backing plate collars 186. The chuck shaft assemblies 176 then resume their axial advance until the core chucks 31 are within the core C and flanges 192 of the core chucks abut the core. Both the bladders 182 within the core chucks 31 and the annular bladders 164 on the backing plates 168 then are inflated to engage the inner surface 175 of the core and the end surfaces 163 of the parent roll. Alternatively, the supplemental torque transfer means 160 and chuck shaft assembly 176 are fixedly connected.

The supplemental torque transfer means 160 described in relation to FIGS. 16–19 are preferred for use with loosely-wound parent rolls having an outside diameter of about 120 inches or greater, for example, about 140 inches or greater. The supplemental torque transfer means reduces or eliminates slippage between individual sheet layers and between sheet layers and the inner roll core, preferably during high acceleration or deceleration periods. The desired level of torque is transferred from the unwind shaft through the roll itself by selection of the coefficient of friction of the side clamping mechanism, the contact area of the side clamping mechanism, and the air pressure of the bladders.

In the foregoing specification, a detailed description has been set down of various embodiments of the present invention for the purpose of illustration. Nevertheless, many variations may be made in the detailed description without departing from the spirit and scope of the invention. Although the invention has been illustrated by the preceding detailed description, the apparatus and method of the present invention are not intended to be construed as being limited to the specific preferred embodiments. Whereas particular embodiments of the invention have been described, numerous variations of the details may be made without departing from the invention as defined in the appended claims which follow.

What is claimed is:

1. A method of making and processing a high bulk tissue web, comprising:

depositing an aqueous suspension of papermaking fibers onto an endless forming fabric to form a web;

drying the web to form a dried web having a bulk of 9.0 grams per cubic centimeter or greater;

winding the dried web to form a plurality of parent rolls each comprising a web wound on a core;

transporting the parent rolls to an unwind stand having torque transmitting clamping means for engaging opposite end surfaces of the parent rolls;

engaging the clamping means on a first parent roll;

partially unwinding the first parent roll using variable speed drive means operably associated with the clamping means;

rotatably supporting the partially unwound first parent roll on a core placement table adapted to receive the partially unwound first parent roll from the clamping means;

engaging torque transmitting clamping means on a second parent roll;

joining a leading end portion of the web on the second parent roll to a trailing end portion of the partially unwound first parent roll by embossing to form a joined web without glue; and rewinding the joined web.

2. The method of making and processing a high bulk tissue web as set forth in claim 1, further comprising transporting the leading end portion of the web on the second parent roll with a thread-up conveyor.

3. The method of making and processing a high bulk tissue web as set forth in claim 2, further comprising transporting the leading end portion of the web with vacuum means operably associated with an endless screen belt means.

4. The method of making and processing a high bulk tissue web as set forth in claim 3, further comprising transporting the leading end portion of the web on the second parent roll with decreasing amounts of vacuum as the web is transported over the endless screen belt means.

5. The method of making and processing a high bulk tissue web as set forth in claim 2, further comprising moving the thread-up conveyor relative to the second parent roll between an active position and a standby position.

6. The method of making and processing a high bulk tissue web as set forth in claim 2, further comprising moving the thread-up conveyor into close proximity or contact with the second parent roll.

7. The method of making and processing a high bulk tissue web as set forth in claim 2, further comprising operating the thread-up conveyor and unwinding the second parent roll at a same surface speed.

8. The method of making and processing a high bulk tissue web as set forth in claim 2, further comprising moving the thread-up conveyor and the core placement table to standby positions while the parent rolls are being unwound.

9. The method of making and processing a high bulk tissue web as set forth in claim 2, wherein the dried web has a bulk from about 10 to about 35 cubic centimeters per gram or greater.

10. The method of making and processing a high bulk tissue web as set forth in claim 2, wherein the parent roll cores have an outside diameter of at least about 14 inches and the parent rolls have an outside diameter of at least about 60 inches and a width of at least about 55 inches.

11. The method of making and processing a high bulk tissue web as set forth in claim 2, wherein the core placement table comprises drive motor means for rotating the partially unwound first parent roll while disposed thereon and energizing the variable speed drive and the drive motor means simultaneously to unwind the webs on both the first and second parent rolls at the same surface speed.

12. A method of making and processing a soft, high bulk, uncreped throughdried tissue web, comprising:

depositing an aqueous suspension of papermaking fibers onto an endless forming fabric to form a web and drying the web by throughdrying to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density;

transferring the web to a throughdrying fabric;

throughdrying the web to form an uncreped throughdried web having a bulk of 6.0 grams per cubic centimeter or greater to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density;

winding the dried web to form a plurality of parent rolls each comprising an uncreped throughdried web wound on a core;

transporting the parent rolls to an unwind stand comprising torque transmitting clamping means for engaging opposite end surfaces of a parent roll;

engaging the clamping means on a first parent roll;

partially unwinding the first parent roll using variable speed drive means operably associated with the clamping means;

rotatably supporting the partially unwound first parent roll on a core placement table adapted to receive the partially unwound first parent roll from the clamping means;

engaging torque transmitting clamping means on a second parent roll;

joining a leading end portion of the web on the second parent roll to a trailing end portion of the partially unwound first parent roll to form a joined web without glue in a finishing unit comprising rolls defining a finishing unit nip;

thereafter substantially continuously forming impacts on the web from the first parent roll in the finishing unit nip while the web is unwound from the first parent roll;

transporting the web from the second parent roll to the finishing unit;

simultaneously passing the webs from both the first and second parent rolls through the finishing unit nip to bond the webs together;

thereafter substantially continuously forming impacts on the web from the second parent roll in the finishing unit nip while the web is unwound from the second parent roll; and rewinding the joined web.

13. The method of making and processing a soft, high bulk tissue web as set forth in claim 12, wherein the finishing unit comprises an embossing unit.

14. The method of making and processing a soft, high bulk tissue web as set forth in claim 12, wherein the finishing unit comprises a calendering unit.

15. The method of making and processing a soft, high bulk tissue web as set forth in claim 12, wherein the finishing unit comprises a crimping unit.

16. A torque transfer device for unwinding a tissue roll having a circumferential surface, opposite end surfaces, an inner core surface, an outside diameter of at least about 60 inches, and a width between the opposite end surfaces of at least about 55 inches, comprising:

a frame comprising a pair of arms spaced apart to accommodate the width of the roll there between, each arm comprising a side clamping mechanism mounted thereon and adapted to engage one of the opposite end surfaces of the tissue roll, the side clamping mechanism comprising:

a backing plate operably connected to and rotatable with an unwind shaft connected to an electric drive means;

an inflatable bladder mounted on the backing plate; and means for inflating the bladder such that the opposite end surfaces of the roll are sandwiched between the side clamping mechanisms.

17. The torque transfer device for unwinding a tissue roll as set forth in claim 16, further comprising a plurality of concentric annular bladders mounted on the backing plate.

18. The torque transfer device for unwinding a tissue roll as set forth in claim 17, further comprising control means adapted to deflate the annular bladders in series moving radially inward as the roll is unwound.

19. The torque transfer device for unwinding a tissue roll as set forth in claim 16, wherein the side clamping mechanisms apply a pressure to the opposite end surfaces of the roll of less than about 2.5 pounds per square inch.

20. The torque transfer device for unwinding a tissue roll as set forth in claim of claim 16, wherein the backing plate has an outside diameter of from about 45 to about 60 inches.

* * * * *